US008834089B2

(12) United States Patent
Goldman et al.

(10) Patent No.: US 8,834,089 B2
(45) Date of Patent: Sep. 16, 2014

(54) PACKAGE ASSEMBLY HANDLING SYSTEM FOR HANDLING CLAMSHELL CONTAINERS CONTAINING A PARTICULATE ALIQUOT

(75) Inventors: Daniel M. Goldman, Des Moines, IA (US); Michael E. Hartman, Des Moines, IA (US); James L. Hunter, Maxwell, IA (US); David L. Johnson, Johnston, IA (US); Griffiths J. Tucker, Davenport, IA (US)

(73) Assignee: Pioneer Hi-Bred International, Inc., Johnston, IA (US)

( * ) Notice: Subject to any disclaimer, the term of this patent is extended or adjusted under 35 U.S.C. 154(b) by 131 days.

(21) Appl. No.: 12/769,426

(22) Filed: Apr. 28, 2010

(65) Prior Publication Data

US 2010/0209221 A1 Aug. 19, 2010

Related U.S. Application Data

(62) Division of application No. 11/774,205, filed on Jul. 6, 2007, now Pat. No. 8,702,371.

(51) Int. Cl.
*B65B 69/00* (2006.01)

(52) U.S. Cl.
CPC ..... *B65B 69/00* (2013.01)
USPC ..... 414/411

(58) Field of Classification Search
USPC ..... 414/411, 412, 810; 30/2; 229/200; 206/815; 222/181.1, 179.5, 626, 622, 222/613, 372, 424.5, 528, 527, 526, 408, 222/407, 406, 344, 328, 206, 214, 185.1, 222/181.3, 181.2; 220/819, 284, 281, 4.23, 220/4.22; 452/13; 111/25; 141/114, 232, 141/254; 446/475; 493/309
See application file for complete search history.

(56) References Cited

U.S. PATENT DOCUMENTS 2,379,090 A 6/1945 Beau
2,729,885 A 1/1956 Wahl et al.

(Continued)

FOREIGN PATENT DOCUMENTS

AT 312 535 B 1/1974
CH 393 179 10/1965

(Continued)

OTHER PUBLICATIONS

The International Search Report and Written Opinion for International Application No. PCT/US2007/072923, completed Mar. 17, 2008, mailed Mar. 28, 2008.

(Continued)

*Primary Examiner* — Saul Rodriguez
*Assistant Examiner* — Glenn Myers
(74) *Attorney, Agent, or Firm* — Pioneer Hi-Bred Int'l, Inc.

(57) ABSTRACT

A package assembly handling system for handling package assemblies in an automated aliquot and/or dispersal processes is provided. Embodiments of the present invention include, but are not limited to, a package assembly handling system for handling a package assembly comprising first and second portions that cooperate to contain a particulate aliquot, the system including a package assembly handling device configured for applying a force to the package assembly so that the first and second portions at least partially separate, thus releasing at least a portion of the particulate aliquot.

20 Claims, 9 Drawing Sheets

(56) References Cited

U.S. PATENT DOCUMENTS

| | | | | | |
|---|---|---|---|---|---|
| 2,738,912 | A | | 3/1956 | Kieffaber | |
| 2,990,073 | A | * | 6/1961 | Textor | 414/303 |
| 2,997,833 | A | * | 8/1961 | Nigrelli et al. | 53/382.1 |
| 2,999,607 | A | | 9/1961 | Tancredi et al. | |
| 3,105,903 | A | * | 10/1963 | Sano et al. | 414/411 |
| 3,443,720 | A | | 5/1969 | Al-roy | |
| 3,853,235 | A | | 12/1974 | Lambert et al. | |
| 3,884,010 | A | | 5/1975 | Bardo et al. | |
| 3,908,824 | A | | 9/1975 | Takahara et al. | |
| 3,937,342 | A | | 2/1976 | Ittner et al. | |
| 4,036,380 | A | | 7/1977 | Berry et al. | |
| 4,792,085 | A | | 12/1988 | Waring, III et al. | |
| 4,807,425 | A | | 2/1989 | Abrams | |
| 4,843,801 | A | | 7/1989 | Roncero | |
| 4,892,220 | A | | 1/1990 | Foos | |
| 5,221,040 | A | | 6/1993 | Sorenson | |
| 5,257,887 | A | | 11/1993 | Kregl | |
| 5,332,147 | A | | 7/1994 | Sorenson | |
| 5,361,562 | A | | 11/1994 | Nagaoka et al. | |
| 5,388,082 | A | | 2/1995 | Chou | |
| 5,388,758 | A | | 2/1995 | Scovell | |
| 5,646,712 | A | | 7/1997 | Solomon et al. | |
| 5,788,114 | A | | 8/1998 | Perego | |
| 5,870,886 | A | * | 2/1999 | Norton | 53/492 |
| 6,068,439 | A | | 5/2000 | Ohta | |
| 6,349,875 | B1 | | 2/2002 | Whitnell | |
| 6,474,500 | B1 | | 11/2002 | Carr et al. | |
| 6,536,194 | B2 | | 3/2003 | Minardi | |
| 6,604,903 | B2 | | 8/2003 | Osborne et al. | |
| 6,706,989 | B2 | | 3/2004 | Hunter et al. | |
| 6,832,567 | B2 | | 12/2004 | Carr et al. | |
| 7,111,567 | B2 | | 9/2006 | Carr et al. | |
| 7,673,572 | B2 | | 3/2010 | Deppermann et al. | |
| 7,775,167 | B2 | | 8/2010 | Stehling et al. | |
| 2006/0124643 | A1 | | 6/2006 | Markert et al. | |

FOREIGN PATENT DOCUMENTS

| | | | |
|---|---|---|---|
| DE | 33 45 565 | A1 | 6/1985 |
| DE | 44 19 475 | A1 | 12/1995 |
| FR | 1 074 246 | | 10/1954 |
| FR | 2 736 333 | A1 | 1/1997 |
| GB | 20118 | | 8/1913 |
| GB | 2 367 814 | A | 4/2002 |
| WO | WO 93/25444 | A1 | 12/1993 |
| WO | WO 2004/048200 | A1 | 6/2004 |
| WO | WO-2005/077811 | A2 | 8/2005 |

OTHER PUBLICATIONS

Office Action from corresponding EP Appl. No. 07812670.3, dated Apr. 28, 2010.

Final Office Action from related U.S. Appl. No. 11/774,205, mailed Nov. 9, 2010.

Office Action issued in connection with European Patent Application No. 07812670.3-2308, issued Jan. 7, 2011.

Office Action issued in connection with European Patent Application No. 07812670.3-2308, issued Jun. 24, 2011.

Office Action issued in connection with Canadian Patent Application No. 2690814, issued Jan. 22, 2013.

Office Action issued in connection with Canadian Patent Application No. 2690814, issued Oct. 9, 2013.

Non-Final Office Action from related U.S. Appl. No. 11/774,205, mailed May 30, 2012.

Final Office Action from related U.S. Appl. No. 11/774,205, mailed Dec. 21, 2012.

Pre-Appeal Brief Conference Decision from related U.S. Appl. No. 11/774,205, mailed May 16, 2013.

Notice of Allowance from related U.S. Appl. No. 11/774,205, mailed Dec. 4, 2013.

* cited by examiner

PACKAGE ASSEMBLY HANDLING SYSTEM FOR HANDLING CLAMSHELL CONTAINERS CONTAINING A PARTICULATE ALIQUOT

CROSS REFERENCE TO RELATED APPLICATIONS

This application is a Divisional of U.S. application Ser. No. 11/774,205, filed Jul. 6, 2007, entitled "Method of Handling Clamshell Containers Containing a Particulate Aliquot," which is hereby incorporated herein in its entirety by reference.

FIELD OF THE INVENTION

The present invention relates generally to methods of handling containers for selectively dispensing one or more objects via automated processes. More specifically, the present invention provides a method for selectively opening a container that contains metered seed sample aliquots. The method applies one or more forces to the container to release one or more objects contained therein.

BACKGROUND OF THE INVENTION

Plant breeding, plant product development, plant product characterization, and plant product commercialization processes often require a large number of particles or components comprising aliquots from a bulk or composite particulate sample, such as a seed sample. For example, in agricultural research, it is often necessary to segregate an aliquot from a bulk sample such that the aliquot includes one or more selected seeds (representing a statistically-significant population, for example). Such aliquots must also sometimes be treated with a selected treatment compound (such as a particular fungicide or insecticide, for example) and packaged with indicia that allows a researcher or field technician to easily identify the aliquot, as well as the handling history and treatment history of the aliquot. An example is disclosed in U.S. Patent Application Publication No. 2008/0009962, entitled "System, Method, and Computer Program Product for Automated High-Throughput Seed Sample Aliquot Preparation, Treatment, and Dispersal," which claims priority from U.S. Provisional Application No. 60/806,684, also entitled "System, Method, and Computer Program Product for Automated High-Throughput Seed Sample Aliquot Preparation, Treatment, and Dispersal," both of which are hereby incorporated by reference herein in their entirety.

Current processes for dispensing packages containing one or more particles or components comprising an aliquot as part of an intermediate research and/or manufacturing step, is a complex and labor-intensive one. Conventional techniques require aliquots to be packaged in small paper coin envelopes. In order to deposit the aliquots for planting research plots, the paper coin envelopes are manually opened at the desired planting locations. Not only is this process very time consuming, requiring a great deal of manual labor, but the paper coin envelopes are not well suited for closing and re-opening, much less re-opening by automated processes.

Some improved containers for use in receiving, containing, and dispensing aliquots have been disclosed, for example in U.S. Provisional Application No. 60/806,660 and U.S. Patent Application Publication No. 2008/0006627, both entitled "Buckling Clamshell Container for Automated Aliquot and Dispersal Processes," the disclosures of which are hereby incorporated by reference in their entirety. These documents generally describe an improved package assembly comprising first and second portions configured to cooperate to contain the particular aliquot. The package assemblies described in these documents are easily closed and re-opened, easily and economically manufactured, and may be provided in a one-piece assembly. Moreover, the package assemblies may be re-used.

However, there is a further need in the art for a method of handling such package assemblies. The method should provide for automated handling of one or more package assemblies and should facilitate separating first and second portions to release at least a portion of the particulate aliquot. Furthermore, there is a need for a method of handling package assemblies that identifies a package assembly label comprising a indicia of the aliquot.

SUMMARY OF VARIOUS EMBODIMENTS

The embodiments of the present invention satisfy the needs listed above and provide other advantages as described below. Embodiments of the present invention may include a method of handling a package assembly containing a particulate aliquot (such as one or more selected types of agricultural seeds) and comprising first and second portions which cooperate to contain the aliquot. According to some embodiments, the method comprises receiving the package assembly in a package assembly handling device, and applying a force to the package assembly using the package assembly handling device so that the first and second portions separate in response to the force, thus releasing at least a portion of the particulate aliquot. In various embodiments, the step of applying a force to the package assembly may comprise, but is not limited to, applying a compressive force to the package assembly; inserting an opening tool between the first and second portions of the package assembly; or applying a force approximately normal to a plane defined by a flange portion of the package assembly; or combinations thereof In some embodiments, the step of receiving the package assembly may comprise receiving a closed package assembly in an inverted orientation wherein the first portion comprises a container portion and the second portion comprises a cover portion, the cover portion being disposed below the container portion and wherein when the cover portion separates from the container portion, the particulate aliquot is released from the package assembly. The step of applying a compressive force in some embodiments may comprise moving the package assembly along a package assembly handling path defined by a pair of opposing guide rails using a pusher assembly, wherein the package assembly passes adjacent a pinch area defined in one of the guide rails, and wherein the pinch area deflects one of opposing sides of the package assembly, thus compressing the package assembly between the pinch area and the other of the guide rails. In other embodiments, the pinch area may comprise, but is not limited to, a geometry of at least one of the guide rails configured such that the guide rails converge as the package assembly moves along the package assembly handling path; one or more pinch rollers defined in at least one of the guide rails and configured to deflect at least one of opposing sides of the package assembly as the package assembly moves along the package assembly handling path; an actuated section of at least one of the guide rails configured to move inward so as to deflect at least one of opposing sides of the package assembly; or at least one adjustable insert or section located in one or both guide rails configured to deflect at least one of opposing sides of the package assembly, the insert or section being configured to adjust the amount of the compression force applied to the package assembly; or combinations thereof Some embodiments may further comprise identifying a package assembly label comprising a indicia of the aliquot using a machine reader device, which may include, but is not limited to, a bar code reader, or an RFID reader, or combinations of such devices.

Some embodiments may further comprise inserting an opening tool between portions of the package assembly. In various embodiments, inserting an opening tool between portions of the package assembly may comprise moving the package assembly relative to a stationary opening tool, moving an opening tool relative to a stationary package assembly, or a combination of both. In some embodiments the opening tool may be inserted into an existing aperture defined by at least one of a pair of opposing concave portions located on a flange portion of the package assembly for encouraging at least one of the first and second portions to flex outwardly from the other portion about the flexure axis so that the first and second portions separate. The step of inserting the opening tool into the aperture may also comprise inserting an opening tool into an aperture defined by at least one of a pair of opposing concave portions located on a first flange portion of the package assembly and at least one concave portion located on a second flange portion of the package assembly and adapted to substantially align with at least one of the pair of opposing concave portions when the first and second portions are closed. The step of inserting the opening tool may also comprise moving the package assembly along a package assembly handling path defined by a pair of opposing guide rails using a pusher assembly so that the aperture of the package assembly contacts a leading end of an opening tool. In addition, the method may further comprise deflecting one of the first or second portions of the package assembly when the first and second portions separate so that the package assembly at least temporarily remains in an open position. Furthermore, the method may also include applying a force approximately normal to a plane defined by the flange portion using the package dispenser, for encouraging the first and second portions to separate. The force may comprise actuating a disengaging tool through a notch portion defined in one of first and second flange portions of the package assembly to exert a force against the other of the first and second flange portions.

In addition to various embodiments describing a method of handling package assemblies, the present invention also provides various embodiments of a package handling system. Thus the various embodiments of the present invention provide many advantages that may include, but are not limited to: providing automated handling of one or more package assemblies; automatically facilitating separation of first and second portions of the package assemblies in response to a compressive force; and identifying package assembly labels comprising indicia of the aliquots.

BRIEF DESCRIPTION OF THE DRAWINGS

Figure 1:
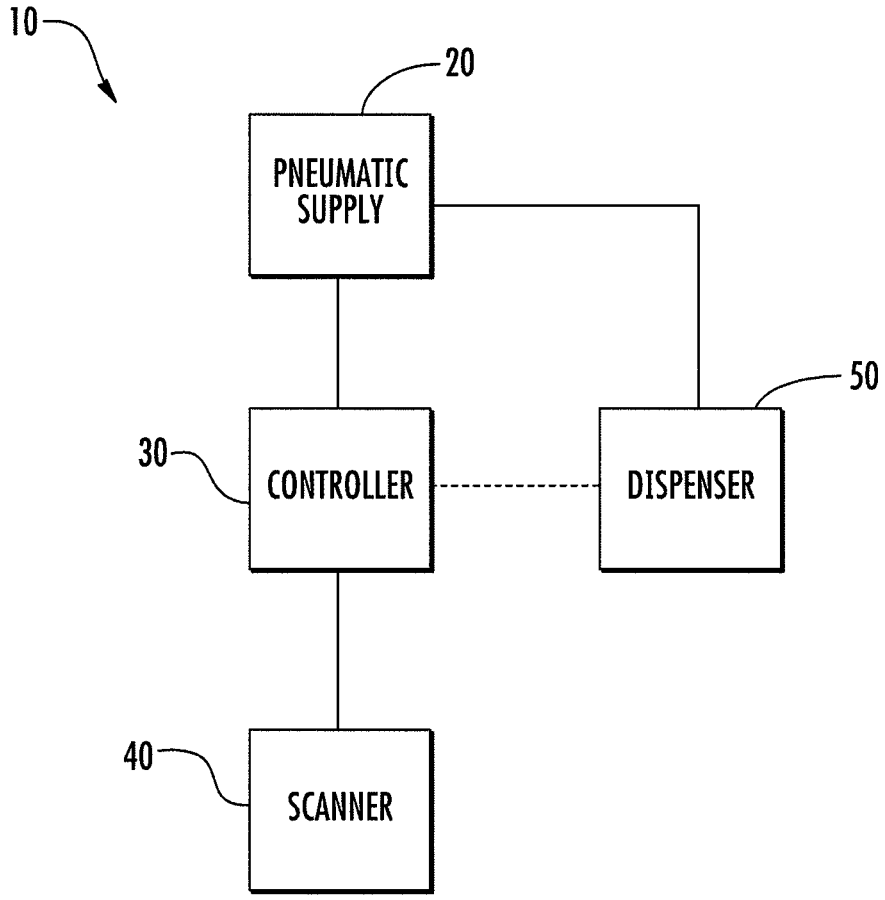
Figure 2:
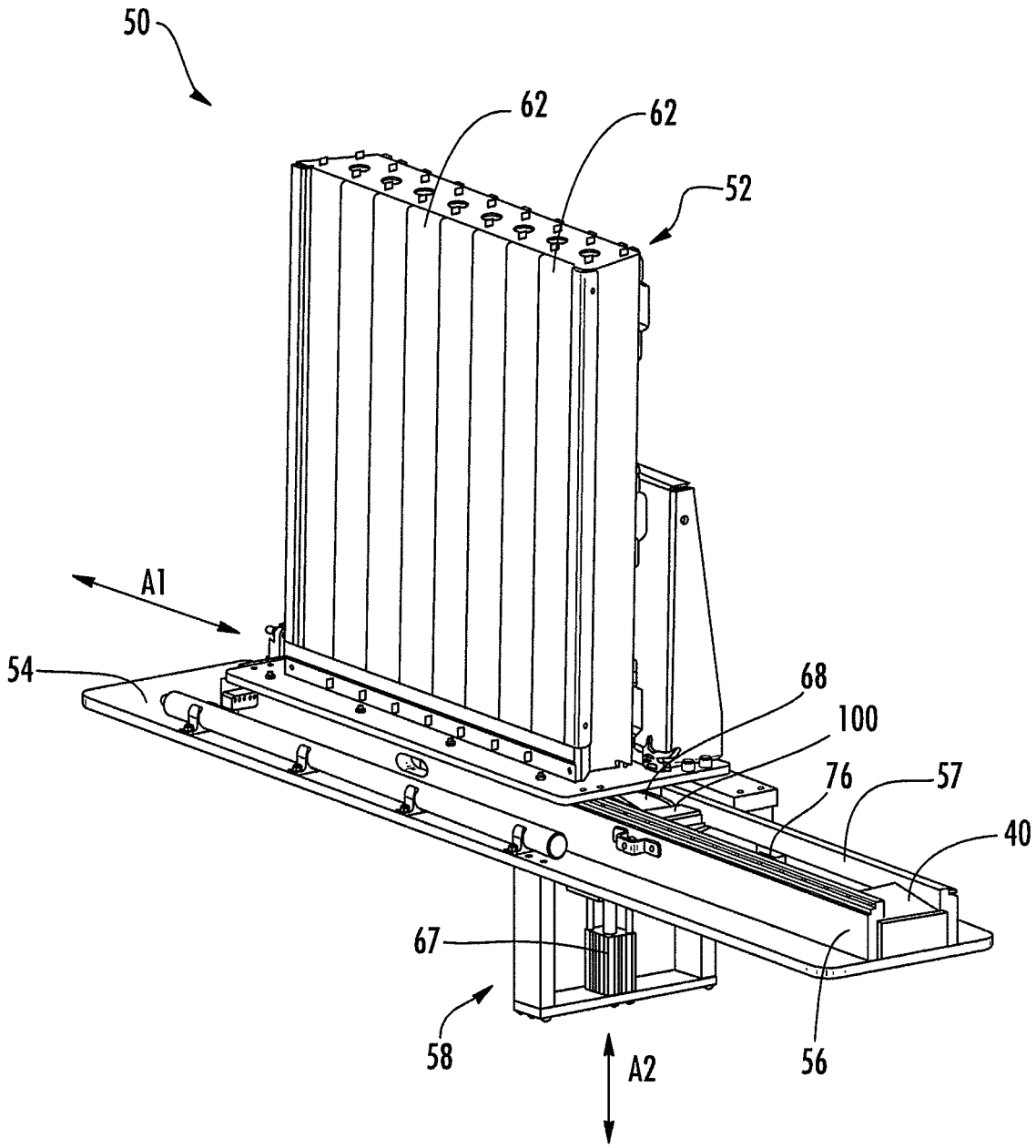
Figure 3:
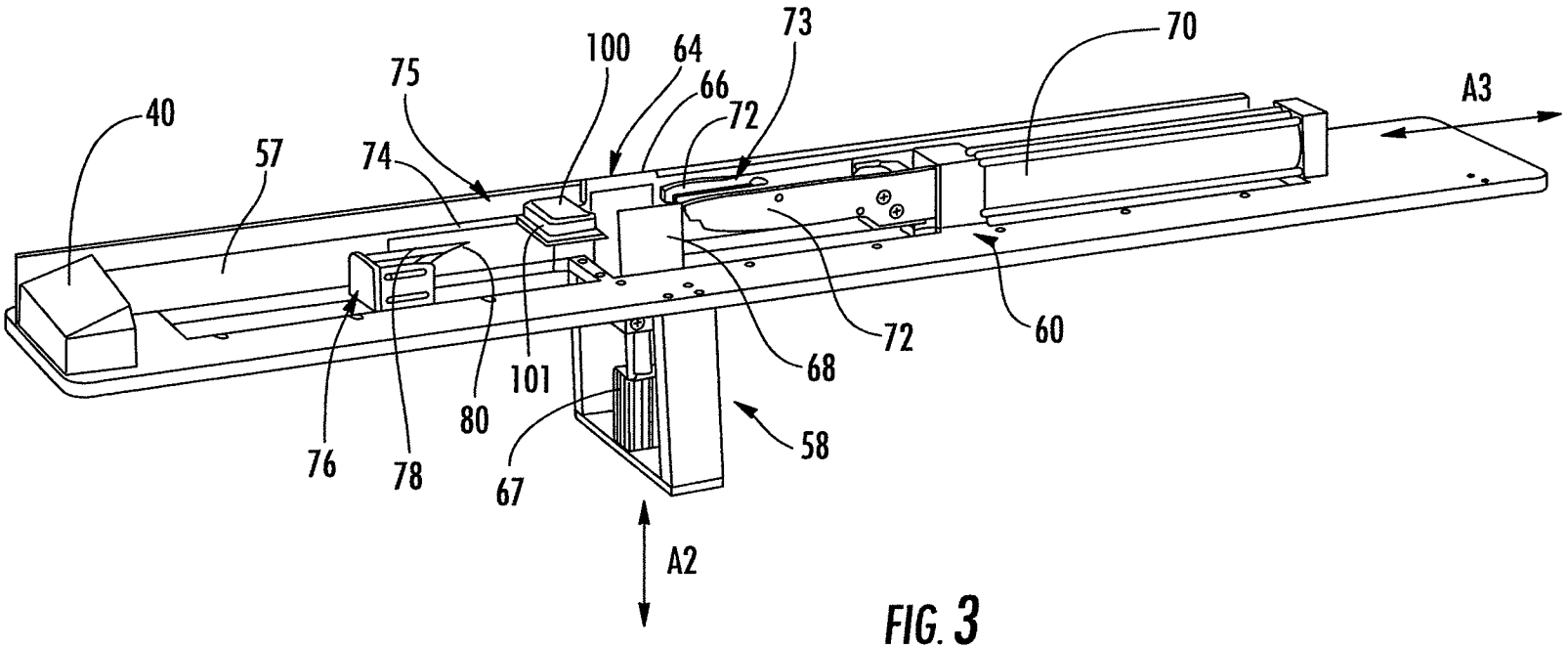
Figure 4:
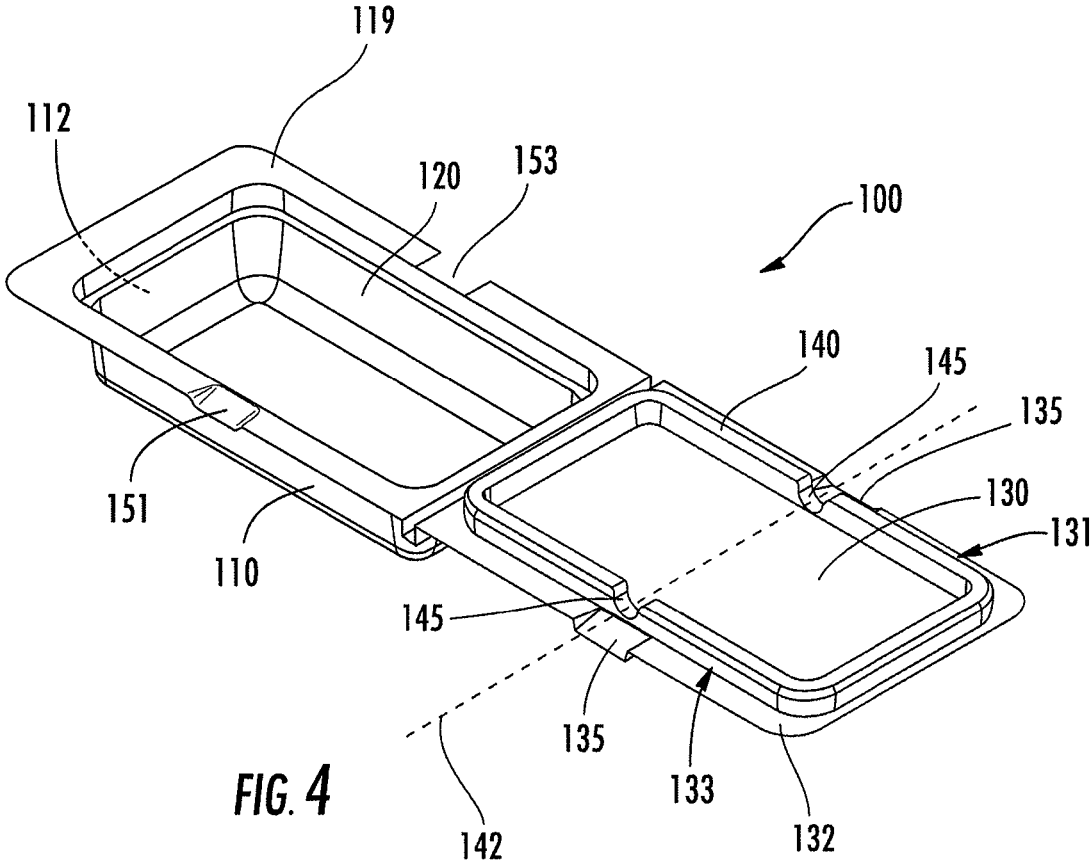
Figure 4A:
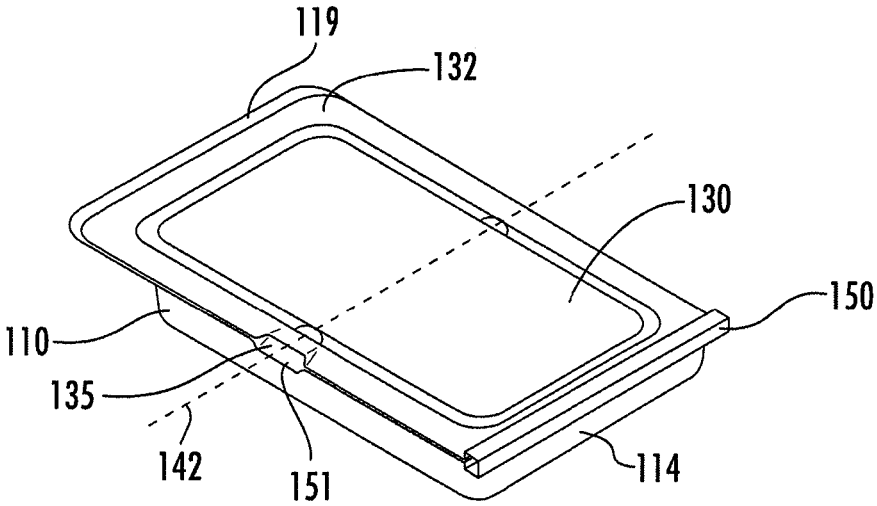
Figure 5:
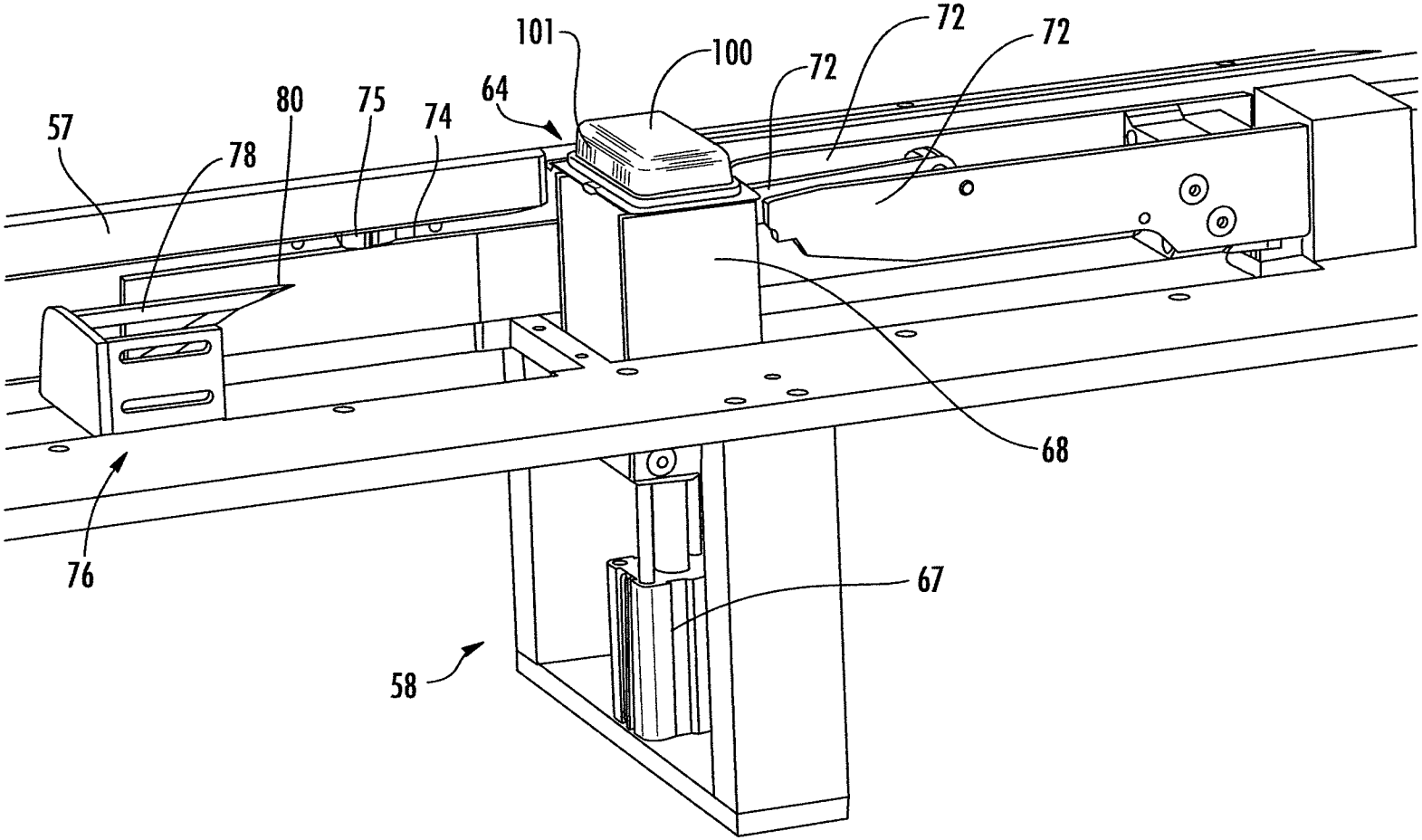
Figure 6:
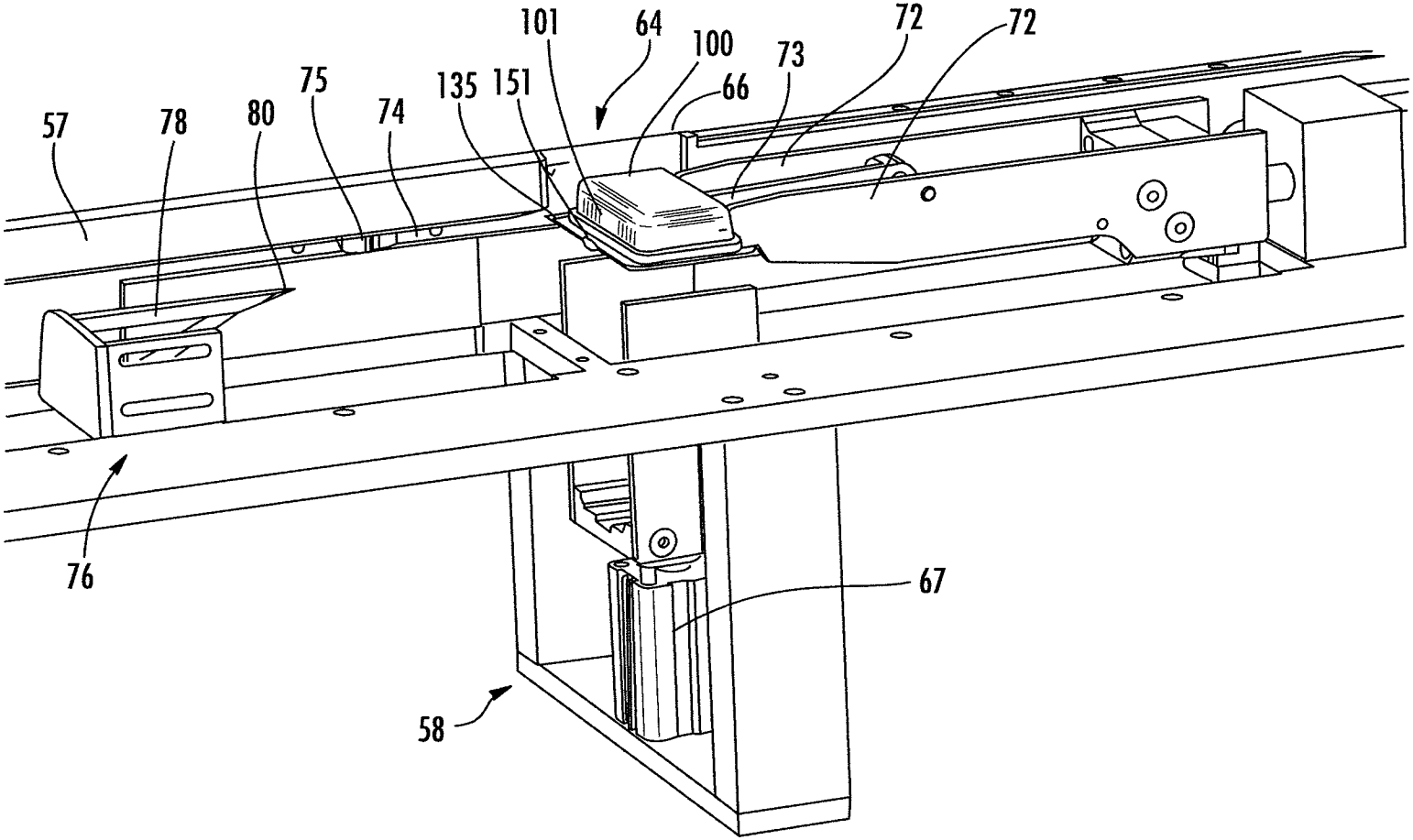
Figure 7:
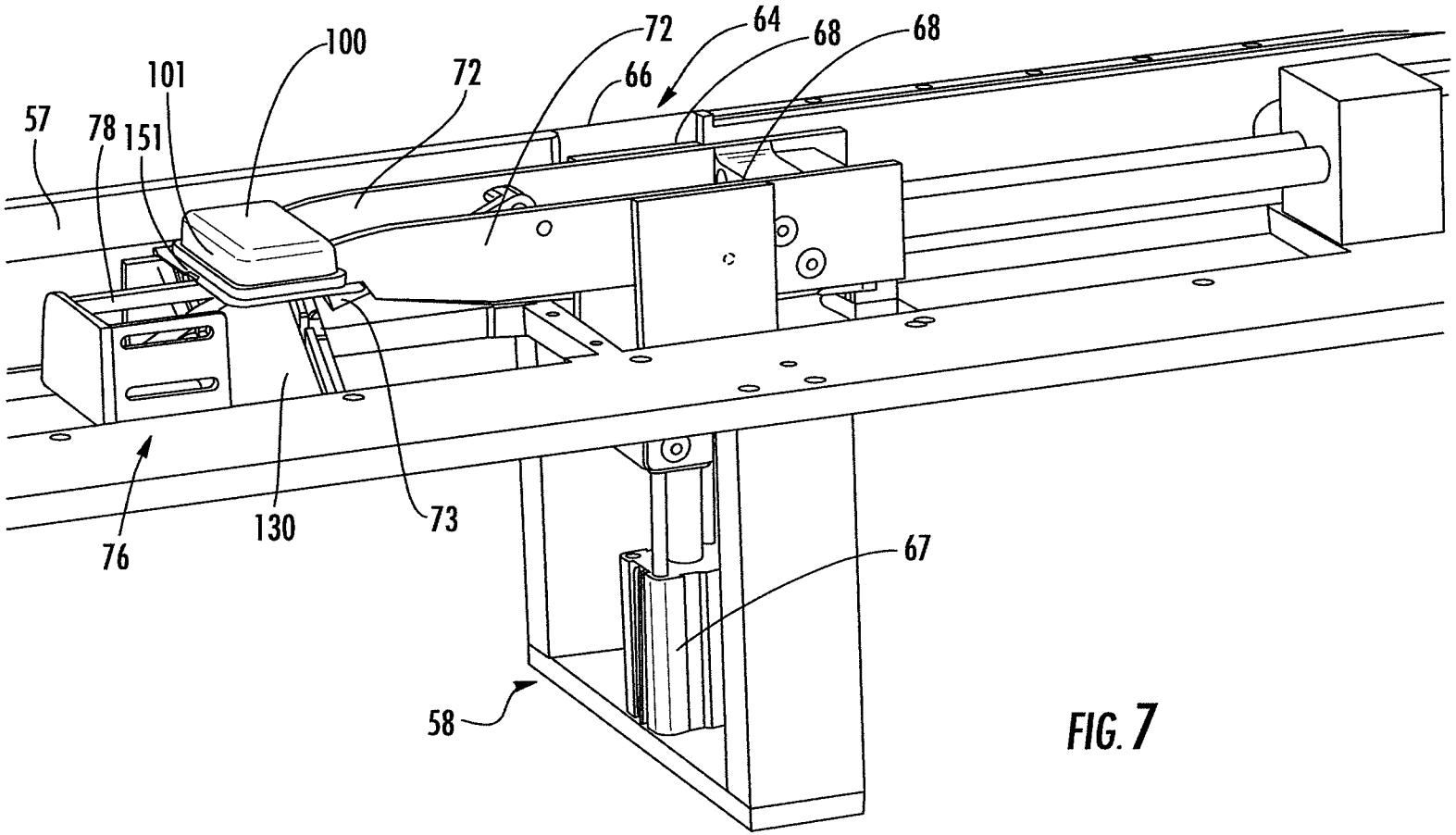
Figure 8:
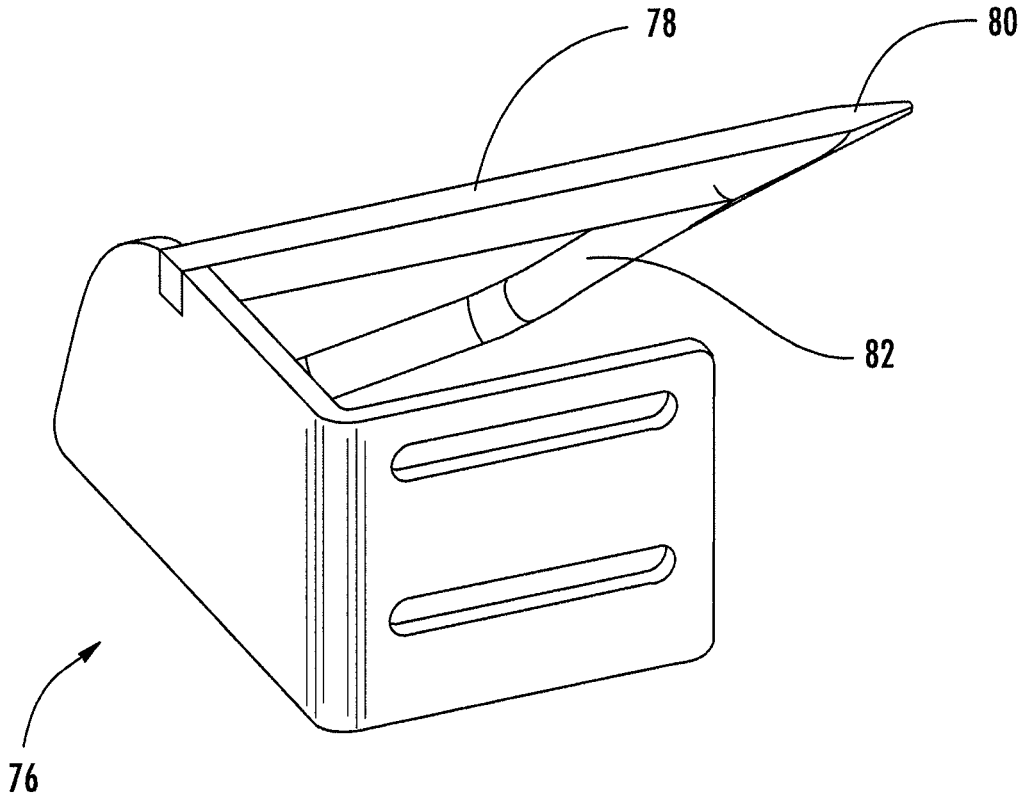
Figure 9:
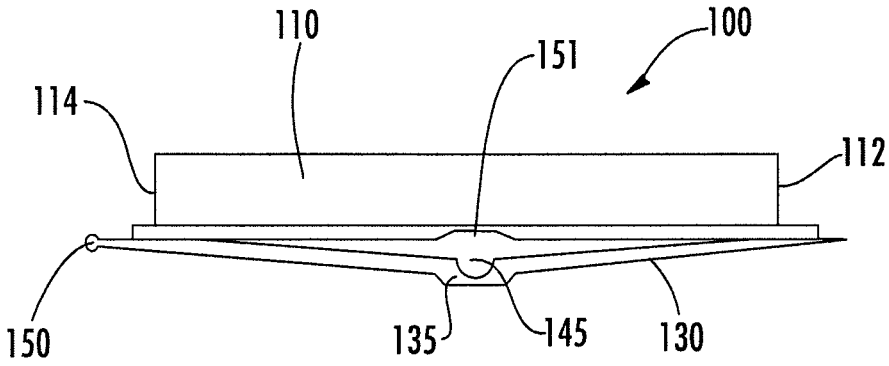
Figure 10:
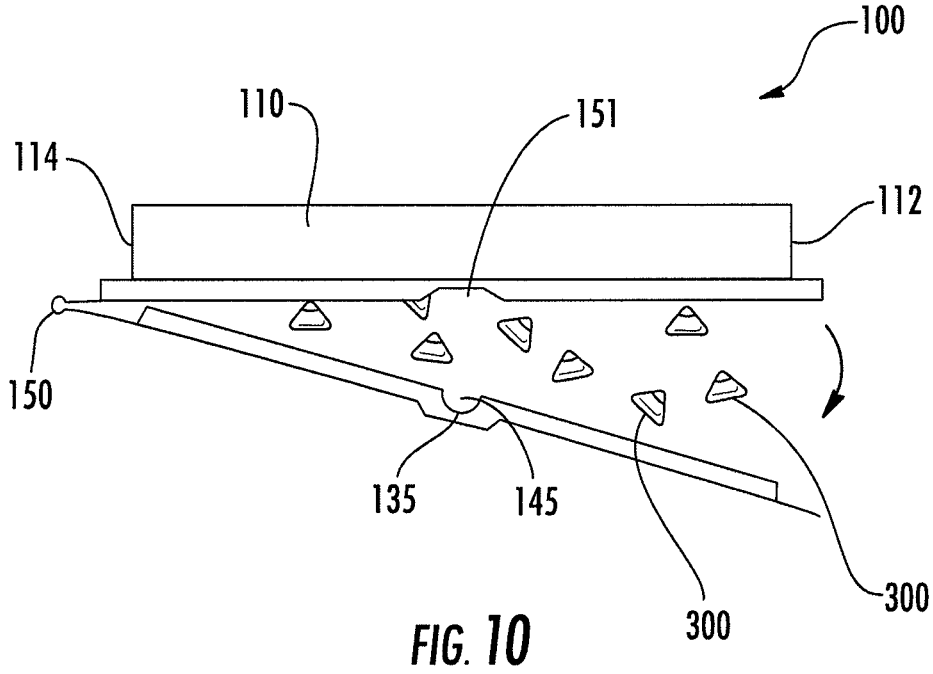

Having thus described the invention in general terms, reference will now be made to the accompanying drawings, which are not necessarily drawn to scale, and wherein:

FIG. 1 shows a schematic diagram showing a package assembly handling system configured to execute a method of handling package assemblies in accordance with one exemplary embodiment of the present invention;

FIG. 2 is a perspective view of a package assembly handling device of a package assembly handling system configured to execute a method of handling package assemblies in accordance with one exemplary embodiment of the present invention;

FIG. 3 shows a perspective view from a reverse angle of the package assembly handling device of FIG. 2 in accordance with one exemplary embodiment of the present invention;

FIG. 4 shows a package assembly, in an open position, for use with the package assembly handling device of FIG. 2 in accordance with one exemplary embodiment of the present invention;

FIG. 4A shows a package assembly, in a closed position, for use with the package assembly handling device of FIG. 2 in accordance with one exemplary embodiment of the present invention;

FIG. 5 shows a perspective view from a reverse angle of the package assembly handling device of FIG. 2 wherein a package assembly is being lowered by an elevator assembly into a package assembly handling path in accordance with one exemplary embodiment of the present invention;

FIG. 6 shows a perspective view from a reverse angle of the package assembly handling device of FIG. 2 wherein a package assembly is being pushed by a pusher assembly along a package assembly handling path in accordance with one exemplary embodiment of the present invention;

FIG. 7 shows a perspective view from a reverse angle of the package assembly handling device of FIG. 2 wherein a package assembly is being pushed by a pusher assembly along a package assembly handling path into an opening tool and wherein a disengaging tool is being actuated, in accordance with one exemplary embodiment of the present invention;

FIG. 8 shows a perspective view from a reverse angle of an opening tool of a package assembly handling device in accordance with one exemplary embodiment of the present invention;

FIG. 9 shows a side view of a package assembly according to one embodiment of the present invention including an exemplary flexing action of a cover portion of the package assembly in response to an applied compressive force; and FIG. 10 shows a side view of a package assembly according to one embodiment of the present invention including disengagement of a cover portion from a container portion after the application of a compressive force.

DETAILED DESCRIPTION

The present invention now will be described more fully hereinafter with reference to the accompanying drawings, in which some, but not all embodiments of the invention are shown. Indeed, this invention may be embodied in many different forms and should not be construed as limited to the embodiments set forth herein; rather, these embodiments are provided so that this disclosure will satisfy applicable legal requirements. Like numbers refer to like elements throughout.

While the embodiments of the present invention are described below in the context of handling package assemblies in an agricultural research environment wherein a package assembly handling device may be used to handle a package assembly to dispense seed aliquots containing seeds of a particular type (such as, for example, seeds corresponding to a selected corn plant hybrid or genetically modified organism (GMO)), it should be understood that embodiments of the method of handling package assemblies of the present invention may also serve as a method for dispensing a variety of particles, components, powders, fluids, foods, and/or other items that may require temporary containment and/or segregation prior to being utilized for a downstream process. Embodiments of the present invention may thus be useful for selectively dispensing such items when required.

As noted above, current processes known in the art for dispensing packages containing one or more particles or components comprising an aliquot as part of an intermediate research and/or manufacturing step, is a complex and labor-intensive one. These prior art techniques often require a great deal of manual labor and time to deposit the aliquots for planting research plots. In general terms, the present invention provides an automated method for handling one or more package assemblies. The method facilitates at least partial separation of first and second portions of a package assembly in response to a force applied to the package assembly, thus releasing at least a portion of the aliquot. The following is a description of the components of a package handling system and a method of handling package assemblies, in accordance with exemplary embodiments of the present invention, however it should be understood that many other embodiments not depicted are possible within the scope of the present invention.

FIG. 1 is a schematic diagram showing a package assembly handling system 10 configured to execute a method of handling package assemblies containing a particulate aliquot in accordance with one exemplary embodiment of the present invention. As shown in the figure, the package assembly handling system 10 of the depicted embodiment comprises a pneumatic supply 20, a controller 30, a scanner 40, and a package assembly handling device 50. The controller 30 controls the pneumatic supply 20, which operates one or more pneumatic components of the package assembly handling device 50. The controller 30 also controls the scanner 40, which, as will be discussed in more detail below, is configured to read information from the package assemblies. The controller 30 may also directly control one or more components of the package assembly handling device 50.

FIG. 2 is a perspective view of the package assembly handling device 50 of one embodiment showing its various components. Generally, the package assembly handling device 50 of the depicted embodiment comprises a tray assembly 52, a base plate 54, first and second guide rails 56, 57, an elevator assembly 58, and a pusher assembly 60 (not visible in FIG. 2). The tray assembly 52 includes an array of bins 62 configured to hold a plurality of package assemblies 100. The base plate 56 is located below the tray assembly 52, with the guide rails 56, 57 mounted in a spaced parallel arrangement on top of the base plate 54, such that the guide rails 56, 57 are disposed directly below the bottom of the tray assembly 52. In the depicted embodiment, the tray assembly 52, base plate 54, guide rails 56, elevator assembly 58, and pusher assembly 60 of the depicted embodiment are constructed primarily of metal materials, such as steel and/or aluminum, however in other embodiments these components may be constructed of any other material(s) suitable for handling package assemblies, as described below.

The tray assembly 52 is oriented with the guide rails 56, 57 such that the bottom of each of the bins 62 is substantially aligned between the guide rails 56, 57. Additionally, the tray assembly 52 is movable in a direction approximately aligned with arrow A1 so that the bottom of each bin 62 may be substantially aligned with a loading area 64 (better viewed in FIG. 3) defined by opposing recesses 66 created in the first and second guide rails 56, 57. The loading area 64 is configured to receive a package assembly 100 for moving along a package assembly handling path defined by the guide rails 56, 57. The elevator assembly 58 is located below the loading area 64 and includes an elevating mechanism 67 which raises and lowers a pair of supports 68 in a direction approximately aligned with arrow A2. The supports 68 are located between the guide rails 56, 57 substantially aligned with the loading area 64. The elevator assembly 58 is configured to move the supports 68 in a direction approximately aligned with arrow A2. In the depicted embodiment, the tray assembly 52, the elevator assembly 58, and the pusher assembly 60 are movable through pneumatic power by control of the controller 30, however in other embodiments any one or any combination of the tray assembly 52, elevator assembly 58, or pusher assembly may be movable by other means, including, but not limited to, gear trains or screw drive systems driven by one or more electric motors controlled by the controller 30.

Although the tray assembly 52 of the depicted embodiment is shown empty, each bin 62 is configured to hold a plurality of package assemblies 100, which may be stacked one on top of another in a closed position. So configured, the tray assembly 52 provides an array of closed package assemblies 100. In the depicted embodiment, the tray assembly 52 creates an array that is 1 row by 8 bins (1×8). However, in other embodiments a tray assembly may comprise a variety of configurations designed to suit differing storage, space, and/or performance constraints. In such embodiments, the tray assembly may be movable in other directions so as to substantially align the bottoms of the bins with a loading area. Alternatively, multiple loading areas may be available to receive package assemblies from the tray assembly.

FIG. 3 is a perspective view from a reverse angle of the package assembly handling device 50 in accordance with the exemplary embodiment of the invention depicted in FIG. 2. In this figure, the tray assembly 52 and the first guide rail 56 have been removed to facilitate discussion. Each of the first and second guide rails 56, 57 includes a support surface 74 which defines the package assembly handling path and along which a package assembly 100 travels after being loaded from the tray assembly 52 into the loading area 64. The pusher assembly 60 includes a pushing mechanism 70 that is configured to move a pair of pusher fingers 72 and a disengaging device 73 in a direction approximately aligned with arrow A3. The pusher fingers 72 are configured to move the package assembly 100 along the package assembly handling path. As will discussed in more detail below, the disengaging device 73 is configured to aid in opening a package assembly 100. The pusher fingers 72 are located between the supports 68 so that when the pair of pusher fingers 72 are moved by the pushing mechanism 70 and/or the pair of supports 68 are moved by the elevating mechanism 67, the pusher fingers 72 and the supports 68 move independent of, and do not interfere with, each other. A pinch area 75 is disposed in the second guide rail 57 along the support surface 74, downstream from the loading area 64. The pinch area 75 is designed to apply a compressive force to the package assembly 100 as the package assembly 100 moves along the package assembly handling path. The pinch area 75 of the depicted embodiment is formed by a geometry of the second guide rail 57, such that a portion of the second guide rail 57 extends out some distance from the second guide rail 57 toward the first guide rail 56 so that the guide rails 56, 57 converge and a compressive force is applied to the package assembly 100 as it moves along the package assembly handling path past the pinch area 75 by squeezing the package assembly 100 between the first and second guide rails 56, 57. In various other embodiments, the pinch area 75 may be formed in a variety of ways including, but not limited to, a geometric configuration of the first and/or second guide rails that results in the first and second guide rails converging such that a compressive force is applied the package assembly; one or more pinch rollers defined by the first and/or second guide rails that extend inward so as to apply a compressive force to the package assembly; one or more actuated sections of the first and/or second guide rails wherein the one or more sections are configured to apply a compressive force to the package assembly when actuated inward; at least one adjustable insert or section located in one or both guide rails configured to deflect at least one of opposing sides of the package assembly, the insert or section being configured to adjust the amount of the compression force applied to the package assembly; and combinations thereof.

An opening tool 76 that includes a spear 78 defining a spear end 80 (shown in more detail in FIG. 8) is located between the guide rails 56, 57 downstream from the loading area 64 and is configured such that a package assembly 100 moving along the package assembly handling path contacts the spear end 80. In the depicted embodiment, the opening tool 76 is constructed of a steel material, however in other embodiments it may be constructed of any material structured to facilitate opening of a package assembly 100.

A scanner 40 is located proximate the package assembly handling path and is configured to read a label 101 containing indicia associated with each package assembly 100 before the package assembly 100 opens to release the aliquot. In the depicted embodiment, the label 101 includes barcode information relating to the aliquot contained in the package assembly 100, however in other embodiments, the scanner 40 may be any other device capable of machine reading a label, including, but not limited to, a radio frequency identification (RFID) reader capable of identifying an RFID transponder associated with the package assembly 100, and/or a combination of a RFID reader and a barcode reader. Additionally, although the scanner 40 of the depicted embodiment of the present invention is located proximate the package assembly handling path downstream from the loading area 64, in other embodiments a scanner could be located in a variety of locations. For example, one or more scanners could be located proximate the tray assembly 52, the pusher assembly 60, the elevator assembly 58, and/or the opening tool 76. In other embodiments, package assemblies could be scanned with an independent scanner prior to being loaded in the tray assembly 52. However, it should be noted that not all embodiments of the present invention include a scanner.

As noted above, improved package assemblies for use in receiving, containing, and dispensing aliquots have been disclosed, for example in U.S. Provisional Application No. 60/806,660 and U.S. Patent Application Publication No. 2008/0006627. FIGS. 4 and 4A show an exemplary package assembly 100 of a type that may be used in conjunction with the dispenser 50 shown in FIGS. 1-3. Specifically, FIGS. 4 and 4A show a perspective view of a package assembly 100, in open and closed positions, respectively, usable in conjunction with the method in accordance with one embodiment of the present invention. As shown, the package assembly 100 may generally comprise a container portion 110 defining an opening 120 and including at least two opposing sides 112, 114. The package assembly 100 may further comprise a cover portion 130 configured to cooperate with the container portion 110 to selectively close the opening 120 defined by the container portion 110. It should be noted, however, that the method of handling package assemblies of various embodiments of the present invention described herein may operate on a variety of package assembly designs and thus the present invention should not be limited to use with the particular package assemblies those shown in the figures.

In order to effectively close the opening 120 defined by the container portion 110 of the depicted embodiment, the cover portion 130 may comprise a reinforcing ridge portion 140 operably engaged about a perimeter of the cover portion 130 and configured to be capable of engaging an inner periphery of the opening 120, in an interference fit, so as to selectively close the opening 120, such that the cover portion 130 is not easily disengaged from the container portion 110 without the application of a compressive force, as described herein. It should be noted that in various embodiments, only a portion of the cover portion 130 and the container portion 110 may cooperate to hold the portions in a closed position. Moreover, an interference fit need not be required to hold the cover portion 130 in a closed position over the opening 120 of the container portion 110. The method of various embodiments of the present invention is operable in conjunction with package assemblies of a variety of designs, which are configured so that first and second portions at least partially separate in response to a force applied to the package assembly. In such a manner, the first and second portions may separate, at least partially, in response to the force, thus releasing at least a portion of a particulate aliquot contained within the package assembly. Thus, for example, package assemblies of other embodiments may comprise independent first and second portions wherein when the portions separate, one of the portions falls away from the other. Additionally, an adhesive or heat sealing material may be used to hold the first and second portions (or a portion of the first and second portions) in a closed position, wherein the adhesive or sealing material is designed to fail when the package assembly is subjected to a force.

The reinforcing ridge portion 140 of the depicted embodiment may also define a pair of flexure channels 145 on opposing sides 131, 133 of the cover portion 130. Furthermore, the flexure channels 145 may cooperate to define a flexure axis 142 extending substantially perpendicularly to the opposing sides 131, 133 of the cover portion 130 defining the flexure channels 145 such that the flexure axis 142 is substantially parallel to the opposing sides 112, 114 of the container portion 110.

According to various embodiments of the present invention, the container portion 110, the cover portion 130, and the opening 120 defined by the container portion may be formed into a variety of different shapes. For example, in some embodiments, the various components of the package assembly 100 may be formed in a substantially rectangular shape. In other embodiments the various components (such as the container portion 110, cover portion 130, and reinforcing ridge portion 140) may be formed to have a variety of other shapes, including but not limited to: polygonal shapes (including, but not limited to rectangles, triangles, hexagons); circular; oval; semi-circular; and combinations of such shapes.

As shown in FIG. 4, the flexure channels 145 defined in the reinforcing ridge portion 140 of the cover portion 130 may have a substantially half-circular cross section. According to other embodiments, the flexure channels 145 may also define various other cross-sectional shapes that may be tailored to define a flexure axis 142 extending substantially perpendicularly to the opposing sides 131, 133 of the cover portion 130. For example, the flexure channels 145 may, in some alternative embodiments, define cross-sectional shapes that may include, but are not limited to: rectangular; oval; circular; triangular; and combinations of such cross-sectional shapes. The shape of the cross-section of the flexure channel 145 may thus be tailored to suit the material used to form the cover portion 130 and/or the reinforcing ridge portion 140 so as to define a distinct flexure axis 142 across a width of the cover portion 130 such that the cover portion flexes outwardly from the container portion 110 about the flexure axis 142 defined by the opposing flexure channels 145 (see, for example, FIG. 9, showing the flexing action of the cover portion 130 about the flexure axis 142 in response to a compressive force applied to the package assembly 100).

Thus, in the depicted embodiment the cover portion 130 may be configured to flex outwardly from the container portion 110 about the flexure axis 142, when a compressive force is applied to at least one of two opposing sides 112, 114 of the container portion 110. The compressive force may thus initiate the disengagement of the reinforcing ridge portion 140 from the inner periphery of the opening 120 so that the cover portion 130 disengages from the container portion 110. The package assembly 100 of the depicted embodiment is inverted such that the cover portion 130 may drop away (see FIG. 10) from the container portion 110 after the reinforcing ridge portion 140 has been disengaged from the inner periphery of the opening 120 due to a compressive force applied to the opposing sides 112, 114 of the container portion 100.

The package assembly 100 may thus be used to disperse one or more particles 300 (such as a seed sample aliquot) that have been segregated and contained within the container portion 110 of the package assembly 100 of the present invention. As described generally above, the package assembly 100 of various embodiments of the present invention may be advantageously opened by the simple application of a compressive force to at least one of the opposing sides 112, 114 of the container portion 110 of the package assembly 100 while suspending the package assembly 100 in an inverted position.

As shown generally in FIG. 4A, the package assembly 100 may further comprise a hinge portion 150 operably engaged between an edge of the cover portion 130 and one of the at least two opposing sides 112, 114 of the container portion 110 such that the cover portion 130 and the container portion 110 may form a substantially unitary package assembly 100 even when the cover portion 130 (and the reinforcing ridge portion 140 extending therefrom) is disengaged from the inner periphery of the opening 120 defined in the container portion 110 (as shown generally in FIG. 9). In some embodiments of the present invention, the hinge portion 150 may be integrally formed with one or both of the container portion 110 and the cover portion 130 to form a unitary package assembly 100. According to some alternative embodiments, the hinge portion 150 may also be operably engaged with one or both of the container portion 110 and the cover portion 130 using an adhesive material in order to form the package assembly 100. As described generally above, the hinge portion 150 may be formed with a bias towards the "open" position (as shown generally in FIG. 9) such that the hinge portion 150 may urge the cover portion 130 generally away from the container portion 110 once the compressive force has caused the initial disengagement of the reinforcing ridge portion 140 from an inner periphery of the opening 120 defined in the container portion 110.

Furthermore, as shown generally in FIGS. 4 and 4A, the package assembly 100 may also comprise a pair of complementary flange portions 119, 132 extending outward from an outer periphery of the opening 120 and the reinforcing ridge portion 140 of the cover portion 130, respectively. For example, the package assembly 100 may further comprise a first flange portion 119 extending substantially perpendicular from at outer periphery of the opening 120, and a second flange portion 132 extending substantially outward from the reinforcing ridge 140 such that when the cover portion 130 closes the opening 120 defined by the container portion 110, the first flange portion 119 is substantially adjacent and parallel to the second flange portion 132. Furthermore, the second flange portion 132 may define a pair of opposing concave portions 135 substantially coaxial with the flexure axis 142. According to such embodiments, the concave portions 135 may form a corresponding pair of apertures between the first and second flange portions 119, 132 when the cover portion 130 closes the opening 120 defined by the container portion 110. For example, in some of such embodiments, the pair of apertures defined by the opposing concave portions 135 formed in the second flange portion 132 may be adapted to be capable of receiving an opening tool 76 (described in more detail with respect to FIGS. 5-8) for encouraging the cover portion 130 to flex outwardly from the container portion 110 about the flexure axis 142 so that the cover portion 130 disengages from the container portion 110. In various embodiments, an opening tool may any implement configured to aid in encouraging package assembly portions to separate, such as a screwdriver, knife, or other narrow-bladed implement, etc. Thus, such opposing concave portions 135 defined in by the second flange portion 132 may serve to define a corresponding pair of apertures between the flange portions 119, 132 so that the opening tool 76 may be inserted into the aperture located at or near the flexure axis 142 so as to further urge the cover portion 130 out of its interference fit with the container portion 110. The package assembly 100 of the depicted embodiment also includes at least one corresponding concave portion 151 defined by the first flange portion 119. The corresponding concave portion 151 is configured such that when the cover portion 130 is engaged with the container portion 110, the container ridge 151 substantially aligns with one of the opposing concave portions 135 defined by the second flange portion 132. In such a manner, the aligned concave portion 135 and corresponding concave portion 151 form a larger aperture between the first and second flange portions 119, 132 when the cover portion 130 closes the opening 120 defined by the container portion 110. As a result, the aperture formed by the concave portion 135 and the corresponding concave portion 135 creates a larger target for receiving an opening tool for encouraging the cover portion 130 to flex outwardly from the container portion 110 about the flexure axis 142 so that the cover portion 130 disengages from the container portion 110. It should be noted that in other embodiments, concave portions need not be included on the package assembly. For such embodiments, an opening tool may still be used to at least partially separate portions of a package assembly by inserting the opening tool between the portions.

A notch portion 153 is defined by the first flange portion 119 of the depicted embodiment. The notch portion 153 is configured to allow a disengaging device 73 (described in more detail with respect to FIGS. 5-7) to exert a force approximately normal to the second flange 132 through the notch portion 153. In such a manner, the disengaging device 73 may further facilitate disengaging the cover portion 130 from the container portion 110. In various embodiments, a disengaging device may be any device, tool, and/or mechanism configured to exert a force through the notch portion 153 against the second flange 132. As such, in various embodiments a disengaging device may be used alone, or in combination with the opening tool 76 received in one or both of the pair of apertures defined by the opposing ridges 135. As a result, in various embodiments, this may increase opening success for packaging assemblies with dimensional variability. It should be noted that although the notch portion 153 shown in the depicted embodiment is generally rectangular in shape, one skilled in the art will recognize that a notch portion in accordance with the present invention may take many other shapes, including, but not limited to, a half circular shape, a half oval shape, a triangular shape, a circular shape, an oval shape, and combinations thereof.

FIGS. 5-7 depict a method of handling a package assembly 100 in accordance with one embodiment of the present invention. In these figures, the tray assembly 52 and the first guide rail 56 have been removed to facilitate discussion. The method of handling package assemblies of various embodiments of the present invention may handle one or a plurality of package assemblies. Referring to depicted embodiment of FIG. 5, although a single package assembly 100 is shown, the description assumes that a stack of package assemblies exists above the package assembly 100. The process begins with the tray assembly 52 moving such that a bin 62 containing a stack of package assemblies is aligned with the loading area 64, which is defined by opposing recessed areas 66 located in the first and second guide rails 56, 57. The distance between the first and second guide rails 56, 57 in the loading area 64 is configured to be slightly greater than the length of the package assembly 100. In this manner, the supports 68 may move into contact with the bottommost package assembly 100 and the stack of package assemblies may be moved up and down by the elevating mechanism 67 proximate the loading area 64. Once a stack of package assemblies has been moved by the tray assembly 52 into a position approximately aligned with the loading area 64, the elevating mechanism 67 moves the supports 68 into contact with the bottommost package assembly 100. The entire stack of package assemblies is then moved downward so that the flanges 119, 132 of the bottommost package assembly 100 approximately align with the support surfaces 74 of the first and second guide rails 56, 57. As the elevating mechanism 67 lowers the stack of package assemblies, the label 101 of the bottommost package assembly 100 is scanned by the scanner 40 (not shown). In this manner, information relating to the bottommost package assembly 100, which is the package assembly entering the package assembly handling path, may be recorded. As the elevating mechanism 67 continues to lower the stack of package assemblies, the flanges 119, 132 of the bottommost package assembly 100 contact the support surfaces 74 of the first and second guide rails 56, 57. As shown in FIG. 4A, in some embodiments the length of second flange portion 132 may be shorter than the length of first flange portion 119 so that when the package assembly 100 is lowered onto the support surfaces 74, the first flange portion 119 contacts the support surface 74 of the second guide rail 57 so that the cover portion 130 may be free to separate from the container portion 110 upon application of a compressive force.

In FIG. 6, the pushing mechanism 70 (not shown) moves the pusher fingers 72 into contact with the bottommost package assembly 100 such that the package assembly 100 may be pushed out from the bottom of the stack of package assemblies, along the package assembly handling path. The top surfaces of the pusher fingers 72 are configured so that as the pusher fingers 72 move the bottommost package assembly 100 out from under the stack of package assemblies and along the package assembly handling path, the remaining stack of package assemblies rides on top of the pusher fingers 72. Once the pusher fingers 72 move past the stack of package assemblies, the elevating mechanism 67 moves the supports 68 upward, lifting the stack of package assemblies off of the pusher fingers 72. The pushing mechanism 70 then continues to drive the pusher fingers 72, thus moving the package assembly 100 along the package assembly handling path defined by the support surfaces 74, past the pinch roller 75. As noted above, the pinch roller 75 extends out some distance from the second guide rail 57 toward the first guide rail 56 such that as the package assembly 100 passes the pinch roller 75, the package assembly 100 is forced against the first guide rail 56 and is thus subjected to a compressive force. In the depicted embodiment, the compressive force is applied against the hinge portion 150 and an opposite end of at least one of the first and second flanges 119, 132. As such the compressive force is applied approximately perpendicular to the flexure axis 142. The compressive force causes the cover portion 130 of the package assembly 100 to flex outwardly from the container portion 110 about the flexure axis 142, which causes the cover portion 130 of the package assembly 100 to bow downward (as shown, for example, in FIG. 9). In some embodiments, this compressive force initiates the disengagement of the reinforcing ridge portion 140 from the inner periphery of the opening 120 so that the cover portion 130 disengages from the container portion 110. As shown in FIG. 10, in such embodiments the cover portion 130 drops away from the container portion 110 after the reinforcing ridge portion 140 has been disengaged from the inner periphery of the opening 120.

In other embodiments, such as the depicted embodiment, additional devices and/or mechanisms may be used to further encourage the cover portion 130 to disengage from the container portion 110. Referring to FIG. 7, once the cover portion 130 is bowed about the flexure axis 142, the pushing mechanism 70 drives the pusher fingers 72 to move the package assembly 100 such it engages an opening tool 76 (shown by itself in FIG. 8). In particular, the package assembly 100 is moved along the package assembly handling path such that an existing aperture defined by one of the opposing concave portions 135 and corresponding concave portion 151 of the package assembly 100 contacts the spear end 80 of the opening tool 76. The opening tool 76 is rigidly attached to the base plate 54 such that as the package assembly 100 continues to move along the package assembly handling path, the spear 78 inserts between the cover portion 130 and the container portion 110 of the package assembly 100.

Concurrently, a disengaging tool 73, which is attached between the pusher fingers 72, is actuated by the movement of the pusher fingers 72 along the package assembly handling path. In the depicted embodiment, the disengaging tool 73 is mechanically actuated by the movement of the pusher fingers 72, however in other embodiments the disengaging tool 73 may be actuated in various other ways. Once actuated, the disengaging tool 73 of the depicted embodiment is configured to push downward through the notch portion 153 defined by the first flange portion 119 of the package assembly 100. In such a manner, the disengaging device 73 exerts a force approximately normal to the second flange 132 through the notch portion 153 further encouraging the cover portion 130 to disengage from the container portion 110. Thus, in the depicted embodiment, the opening tool 76 and the disengaging tool 73 ensure that the cover portion 130 completely disengages from the container portion 110.

If, as shown in the figures, the package assembly 100 is inverted, the cover portion 130 drops away from the container portion 110 after the reinforcing ridge portion 140 has been disengaged from the inner periphery of the opening 120. Once the cover portion 130 has disengaged from the container portion 110, a deflecting arm 82 of the opening tool 78 deflects the cover portion 130 such that it is held away from the container portion. As shown generally in FIG. 10, the package assembly 100 may thus be used to disperse a plurality of particles 300 (such as a seed sample aliquot) that have been segregated and contained within the container portion 110 of the package assembly 100 of the present invention.

It should be noted that although the depicted embodiments show a method in which portions of a package assembly are at least partially separated by applying several forces to the package assembly (i.e., applying a compressive force to opposing sides of the package assembly, inserting an opening tool between portions of the package assembly, and applying an approximately normal force to a flange defined in one portion of the package assembly), in other embodiments a package assembly may be at least partially separated by applying any one force to the package assembly or any combination of forces to the package assembly. Additionally, although the depicted embodiments show a method in which portions of a package assembly are at least partially separated by applying several forces to the package assembly as the package assembly moves along a package assembly handling path, in other embodiments any one force may be applied to the package assembly or any combination of forces may be applied to the package assembly without requiring the package assembly to move along a package assembly handling path. That is, in other embodiments any one force or any combination of forces adapted to at least partially separate portions of a package assembly may act on an unmoving package assembly.

Many modifications and other embodiments of the invention will come to mind to one skilled in the art to which this invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. A package assembly handling system for handling a package assembly comprising first and second portions that cooperate to contain a particulate aliquot, the system comprising:

a package assembly handling device configured for applying a compressive force to opposing sides of the second portion of the package assembly using a pinch area so that the first portion flexes outwardly about a flexure axis defined in the first portion, the flexure axis moves away from the second portion, and the first and second portions at least partially separate, thus releasing at least a portion of the particulate aliquot;

an opening tool configured for inserting into an aperture defined by at least one of a pair of opposing concave portions located on a flange portion of the package assembly, for encouraging at least one of the first or second portions to flex outwardly from the other portion about the flexure axis so that the first and second portions separate; and a disengaging tool configured for applying a second force to the package assembly, approximately normal to a plane defined by the flange portion, for encouraging the first and second portions to separate.

2. The package assembly handling system according to claim 1, wherein the compressive force comprises inserting the opening tool between the first and second portions of the package assembly.

3. The package assembly handling system according to claim 1, wherein the compressive force comprises a force approximately normal to a plane defined by the flange portion of the package assembly.

4. The package assembly handling system according to claim 1, further comprising a pusher assembly, and a pair of guide rails defining a package assembly handling path, wherein the pinch area is defined in at least one of the guide rails and substantially along the package assembly handling path, wherein the pusher assembly is configured for moving the package assembly along the package assembly handling path adjacent the pinch area, and wherein the pinch area is configured for depressing at least one of the opposing sides of the package assembly.

5. The package assembly handling system according to claim 4, wherein the pinch area is defined by one of the group consisting of:

a geometry of the pair of guide rails configured such that a portion of at least one of the guide rails extends toward the other guide rail to apply the compressive force as the package assembly moves along the package assembly handling path;

one or more pinch rollers defined in at least one of the guide rails and configured to deflect at least one of the opposing sides of the package assembly as the package assembly moves along the package assembly handling path;

an actuated section of at least one of the guide rails configured to move inward so as to deflect at least one of the opposing sides of the package assembly; and combinations thereof.

6. The package assembly handling system according to claim 1, further comprising a pusher assembly and a pair of guide rails defining a package assembly handling path, and wherein the pusher assembly is configured for moving the package assembly along the package assembly handling path so that the aperture of the package assembly contacts a leading end defined by the opening tool.

7. The package assembly handling system according to claim 6, wherein the first and second portions of the package assembly are joined at one end by a hinge, and wherein the opening tool further defines a deflecting arm configured to deflect one of the first or second portions of the package assembly when the first and second portions separate so that the package assembly at least temporarily remains in an open position.

8. The package assembly handling system according to claim 1, further comprising a machine reader device configured for identifying a package assembly label comprising indicia of the aliquot.

9. The package assembly handing system according to claim 8, wherein the machine reader device comprises a device selected from the group consisting of:

a bar code reader;

an RFID reader; and combinations thereof.

10. A package assembly handling system for handling package assembly comprising first and second portions that cooperate to contain a particulate aliquot, the system comprising:

a package assembly handling device configured for applying a compressive three to opposing sides of the second portion of the package assembly using a pinch area so that the first portion flexes outwardly about a flexure axis defined in the first portion, the flexure axis moves away from the second portion, and the first and second portions at least partially separate, thus releasing at least a portion of the particulate aliquot; and a pusher assembly, and a pair of guide rails defining a package assembly handling path, wherein the pinch area is defined in at least one of the guide rails and substantially along the package assembly handling path, wherein the pusher assembly is configured for moving the package assembly along the package assembly handling path adjacent the pinch area, and wherein the pinch area is configured for depressing at least one of the opposing sides of the package assembly, wherein the pinch area is defined by one of the group consisting of:

a geometry of the pair of guide rails configured such that a portion of at least one of the guide rails extends toward the other guide rail to apply the compressive force as the package assembly moves along the package assembly handling path;

one or more pinch rollers defined in at least one of the guide rails and configured to deflect at least one of the opposing sides of the package assembly as the package assembly moves along the package assembly handling path;

an actuated section of at least one of the guide rails configured to move inward so as to deflect at least one of the opposing sides of the package assembly; and combinations thereof.

11. The package assembly handling system according to claim 10, further comprising an opening tool configured for inserting into an aperture defined by at least one of a pair of opposing concave portions located on a flange portion of the package assembly, for encouraging at least one of the first or second portions to flex outwardly from the other portion about the flexure axis so that the first and second portions separate.

12. The package assembly handling system according to claim 11, further comprising a disengaging tool configured for applying a second force to the package assembly, approximately normal to a plane defined by the flange portion, for encouraging the first and second portions to separate.

13. The package assembly handling system according to claim 10, further comprising a machine reader device configured for identifying a package assembly label comprising indicia of the aliquot.

14. The package assembly handling system according to claim 13, wherein the machine reader device comprises a device selected from the group consisting of:

a bar code reader;

an RFID reader; and combinations thereof.

15. A package assembly handling system for handling a package assembly comprising first and second portions that cooperate to contain a particulate aliquot, the system comprising:

a package assembly handling device configured for applying a compressive force to opposing sides of the second portion of the package assembly using a pinch area so that the first portion flexes outwardly about a flexure axis defined in the first portion, the flexure axis moves away from the second portion, and the first and second portions at least partially separate, thus releasing at least a portion of the particulate aliquot;

an opening tool configured for inserting into an aperture defined by at least one of a pair of opposing concave portions located on a flange portion of the package assembly, for encouraging at least one of the first or second portions to flex outwardly from the other portion about the flexure axis so that the first and second portions separate; and a pusher assembly and a pair of guide rails defining a package assembly handling path, and wherein the pusher assembly is configured for moving the package assembly along the package assembly handling path so that the aperture of the package assembly contacts a leading end defined by the opening tool.

16. The package handling system according to claim 15, further comprising a disengaging tool configured for applying a second force to the package assembly, approximately normal to a plane defined by the flange portion, for encouraging the first and second portions to separate.

17. The package handling system according to claim 15, wherein the pinch area is defined in at least one of the guide rails and substantially along the package assembly handling path, wherein the pusher assembly is configured for moving the package assembly along the package assembly handling path adjacent the pinch area, wherein the pinch area is configured for depressing at least one of the opposing sides of the package assembly, and wherein the pinch area is defined by one of the group consisting of:

a geometry of the pair of guide rails configured such that a portion of at least one of the guide rails extends toward the other guide rail to apply the compressive force as the package assembly moves along the package assembly handling path;

one or more pinch rollers defined in at least one of the guide rails and configured to deflect at least one of the opposing sides of the package assembly as the package assembly moves along the package assembly handling path;

an actuated section of at least one of the guide rails configured to move inward so as to deflect at least one of the opposing sides of the package assembly; and combinations thereof.

18. The package assembly handling system according to claim 15, wherein the first and second portions of the package assembly are joined at one end by a hinge, and wherein the opening tool further defines a deflecting arm configured to deflect one of the first or second portions of the package assembly when the first and second portions separate so that the package assembly at least temporarily remains in an open position.

19. The package assembly handling system according to claim 15, further comprising a machine reader device configured for identifying a package assembly label comprising indicia of the aliquot.

20. The package assembly handing system according to claim 19, wherein the machine reader device comprises a device selected from the group consisting of:

a bar code reader;

an RFID reader; and combinations thereof.

* * * * *